US007287399B2

(12) United States Patent
Obrist et al.

(10) Patent No.: US 7,287,399 B2
(45) Date of Patent: Oct. 30, 2007

(54) COLLECTOR FOR THE LIQUID PHASE OF THE WORKING MEDIUM OF AN AIR-CONDITIONING SYSTEM

(75) Inventors: Frank Obrist, Bregenz (AT); Peter Kuhn, Weinheim (DE); Uwe Wuitz, Lustenau (AT)

(73) Assignee: Obrist Engineering GmbH, Lustenau (AT)

( * ) Notice: Subject to any disclaimer, the term of this patent is extended or adjusted under 35 U.S.C. 154(b) by 286 days.

(21) Appl. No.: 11/053,675

(22) Filed: Feb. 8, 2005

(65) Prior Publication Data

US 2005/0229632 A1 Oct. 20, 2005

(30) Foreign Application Priority Data

Feb. 17, 2004 (CH) ..... 00275/04

(51) Int. Cl.
*F25B 43/00* (2006.01)

(52) U.S. Cl. ..... 62/512; 62/503

(58) Field of Classification Search ..... 62/114, 62/471, 502, 503, 512
See application file for complete search history.

(56) References Cited

U.S. PATENT DOCUMENTS 5,551,255 A * 9/1996 Rothfleisch ..... 62/502
6,062,039 A * 5/2000 Haramoto et al. ..... 62/503

* cited by examiner

*Primary Examiner*—Melvin Jones
(74) *Attorney, Agent, or Firm*—Ladas and Parry LLP

(57) ABSTRACT

A collector for a liquid phase of a working medium of an air-conditioning system has a one-piece collecting container with a solid upper end wall and thickened base region for coupling blocks of a high-pressure piping system and a device for emergency emptying. Flow through an upper region of the collecting container takes place in cyclone fashion starting from an inflow channel, whose outflow direction is tangential to the inner surface of the collecting container whereas the outflow from the collecting container takes place via an end piece of a piping system arranged centrally in the collecting container.

15 Claims, 3 Drawing Sheets

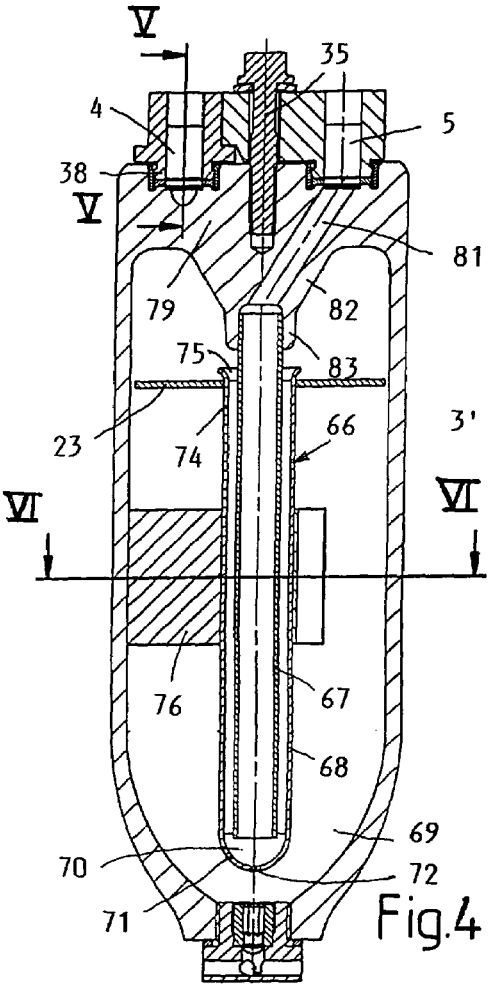
Fig.4
Fig.7
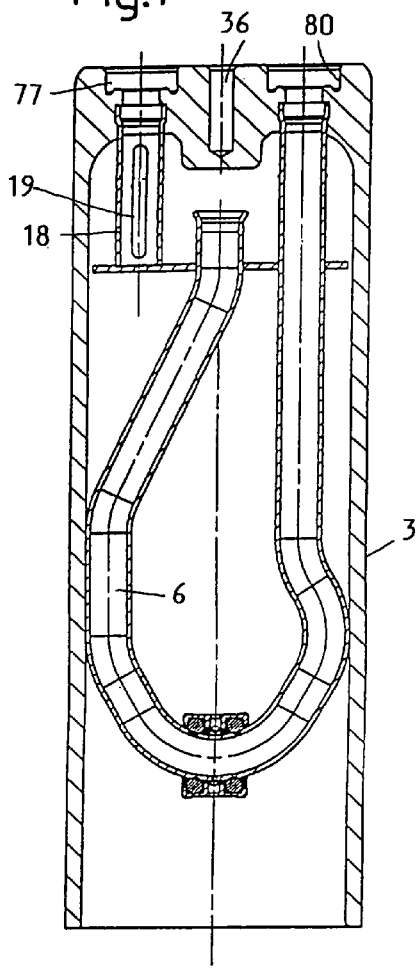
Fig.5
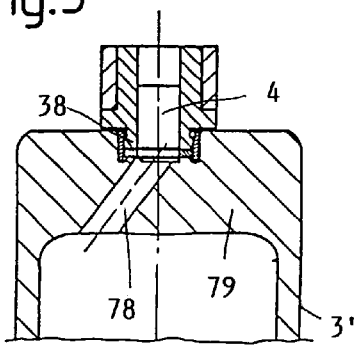
Fig.6
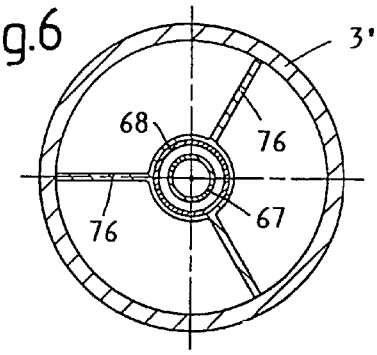

COLLECTOR FOR THE LIQUID PHASE OF THE WORKING MEDIUM OF AN AIR-CONDITIONING SYSTEM

BACKGROUND OF THE INVENTION

The invention relates to a collector for the liquid phase of the working medium of an air-conditioning system, comprising a first and second connecting channel which are guided at a diametral distance and parallel to one another vertically through a solid head-side end wall of a cylindrical collecting container provided for the vertical arrangement and comprising a piping system connected to the second connecting channel which is guided through the interior of the collecting container and runs through its bottom region with a deflection and its end piece discharges openly in the upper region of the collecting container, wherein the piping system in the area of the deflection has at least one opening for returning collected oil into the circuit of the air-conditioning system.

A collector of this type is known from EP 1046872. Since the inlet opening of the open end piece of the pipe of this collector is arranged opposite to the head-side intake channel, the open end piece is enclosed by a hood which also causes a deflection of the inflowing medium to the container wall and downwards. A separation of the liquid phase and especially its oil fraction is not favoured by such flow guidance. Usage of this collector for higher pressures and with an inverted direction of flow is not provided.

The object of the invention is to provide a collector of said type which has an improved separating effect with a simple design structure and which is especially also suitable for the heating mode of a $CO_2$ air-conditioning system.

DESCRIPTION OF THE INVENTION

Said object is solved according to the invention in that the outflow direction of the first connecting channel is directed tangentially to the cylindrical inner surface of the collecting container and the open end piece of the piping system is arranged in the container axis so that the upper region of the collecting container forms a cyclone chamber.

Advantageous embodiments of the invention are the subject matter of the dependent claims and can be deduced from the following description with reference to the drawings.

BRIEF DESCRIPTION OF THE DRAWINGS

FIG. 4 is a third exemplary embodiment of a collector according to the invention in axial section, FIG. 5 is an axial section of the head region of the collector along the line V-V in FIG. 4, FIG. 6 is a radial section along the line VI-VI in FIG. 4 and FIG. 7 is an axial section through the collector according to FIG. 1 before constructing its bottom region.

DETAILED DESCRIPTION OF EMBODIMENTS OF THE INVENTION

Figure 1:
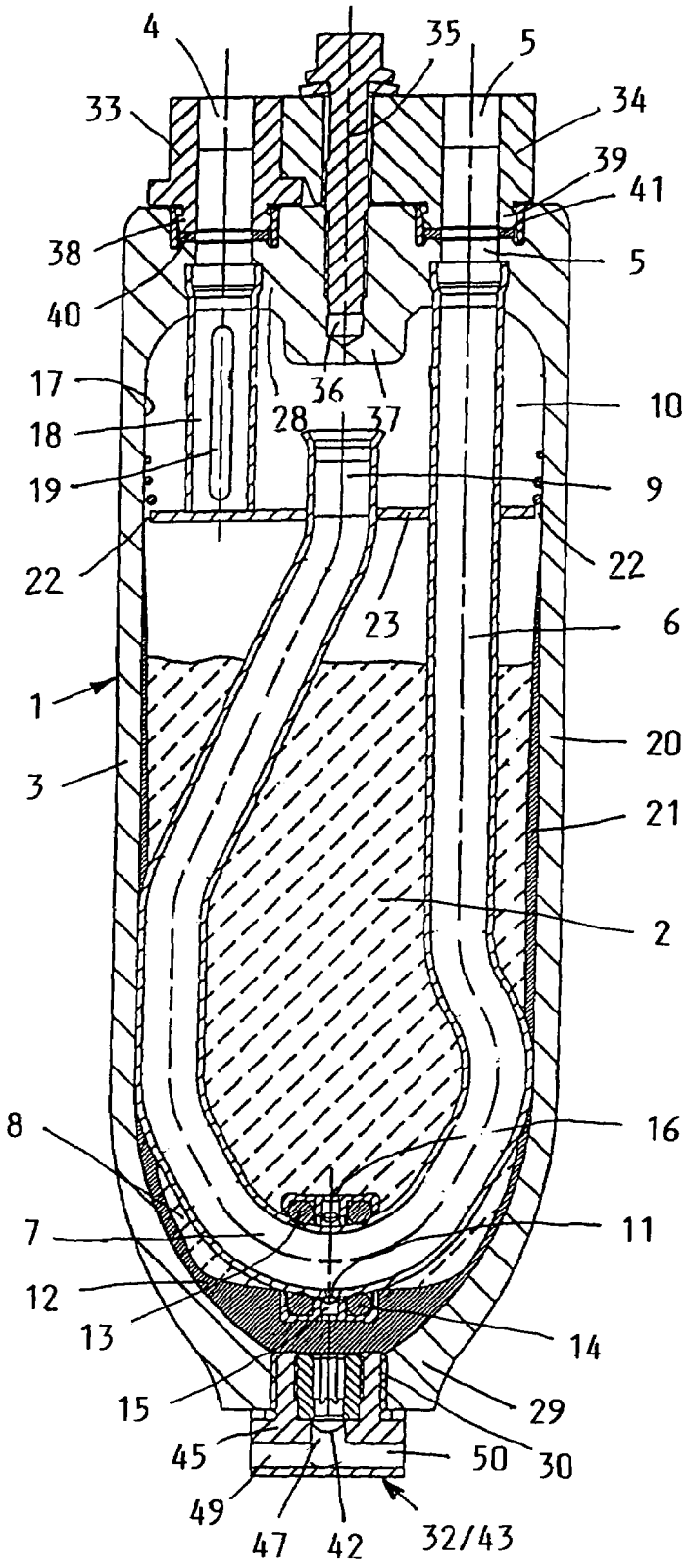
FIG. 1 is a first exemplary embodiment of a collector according to the invention in axial section.

The collector 1 for the liquid phase 2 of the working medium of an air-conditioning system has a cylindrical collecting container 3 provided for vertical arrangement, preferably in the engine compartment of a vehicle, at which a first and second connecting channel 4, 5 are provided for connection of the collector 1 to the piping system of an air-conditioning system. Connected to the second connecting channel 5 is a pipe 6 which extends in a U-shape through the container 3 such that its U-bend 7 runs through the base region 8 of the container 3 and its open end piece 9 ends freely in the upper region 10 of the container 3.

In the lowest region, i.e., in the area of the U-bend 7, the pipe 6 has at least one suction opening 11 for oil 12 whose specific weight is greater than that of the liquid phase 2 of the working medium so that it settles below the liquid phase 2. A filter chamber 15 which surrounds the pipe and is sealed at the sides by O-rings 13, 14, having an outer filter sleeve 16 is used to filter off any impurities contained in the oil 12. For separating the liquid phase and also for separating oil from the medium flowing into the collector 1, the upper container region 10 delimited by the cylindrical inner surface 17 of the container 3 is executed as a cyclone chamber. For this purpose there is connected to the first connecting channel 4 a pipe connecting piece 18 running parallel to the cylindrical inner surface 17 of the container 3, having a peripheral opening 19 which is provided at a circumferential region directed tangentially to the inner surface 17 of the container 3. In addition, for this purpose the open end piece 9 of the pipe 6 is arranged on the container axis. As a result of this arrangement which is constructively simple to achieve, a rotational flow beginning along the inner surface 17 is obtained. This is favoured by the central arrangement of the open end piece 9 of the pipe 6 since the further flow can consequently take place in the form of a continuous spiral flow into the end piece 9. A cylindrical construction of this spiral or vortex flow is advantageously achieved by the peripheral opening 10 of the pipe connecting piece 18, which projects from above into the container 3, extending axially parallel over at least approximately its entire length. This flow guidance also favours the separation of the oil 12 entrained in the compressor of the air-conditioning system from the liquid phase of the operating medium so that this can flow downwards along the cylindrical container wall 20 in the form of an oil film 21.

In order to prevent the intensive spiral flow in the cyclone chamber formed in the upper container region 10 having an agitating effect on the liquid phase separated in the collecting container, which could lead to renewed mixing with oil which has already been separated, the cyclone chamber is shielded with respect to the region of the collecting container (3) provided for storage of the liquid phase, which is located there-under, by a horizontal dividing wall 23 which surrounds the open end piece 9 of the piping 6 in a collar shape and in a circular-disk shape and extends as far as a circumferential drainage gap 22 onto the cylindrical wall 17 of the collecting container 3. In this case, the length of the pipe connecting piece 18 having the peripheral opening 19 is selected so that this extends as far as the dividing wall 23 and for example, is closed thereby at the end.

Figure 2:
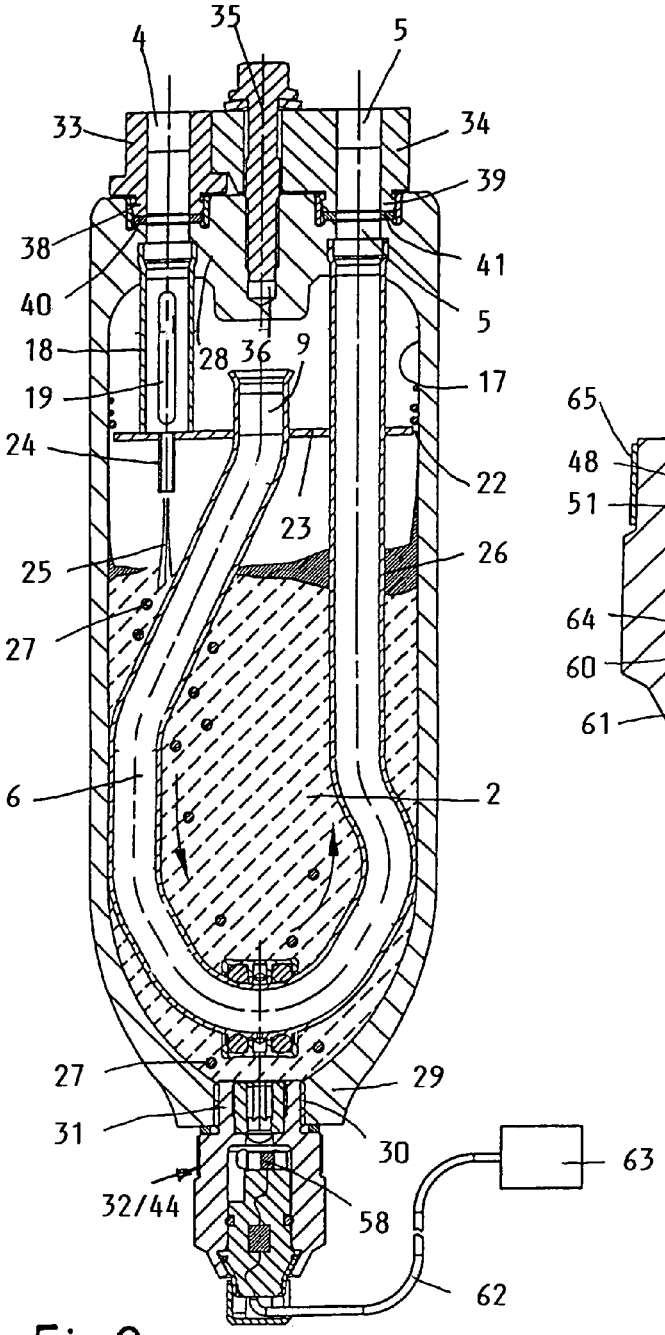
FIG. 2 is a second exemplary embodiment of a collector according to the invention in axial section.

When a lubricating oil is used for the compressor of the air-conditioning system not shown, whose specific weight is less than that of the liquid phase 2 of the operating medium, a nozzle pipe 24 which extends through the dividing wall 23 is provided as an extension of the pipe connecting piece 18 in accordance with the exemplary embodiment according to FIG. 2 so that its outlet jet 25 hits the surface of the liquid medium collected in the container and mixes the floating oil layer with the liquid phase 2 of the operating medium. As a result, the oil can be supplied via the suction opening 11 of the pipe 6 into the circuit of the air-conditioning system and thus to the compressor, as shown by the oil drop 27 in FIG. 2.

The collecting container 3 designed as a high-pressure container for a $CO_2$ air-conditioning system with heating mode and thus for a test pressure substantially higher than 200 bar has a solid end wall 28 at its head, through which the connecting channels 4, 5 extend and a relatively thick container wall 20 which towards the bottom goes over seamlessly into a bottleneck-shaped, arched solid base wall 29 which was produced from a previously cylindrical sleeve wall as shown in the diagram in FIG. 7, by material forming. As a result of this construction of the base wall which is cold-formed towards the inside as far as a central opening 30, an internal thread cut into this opening 30 has sufficient length to receive the threaded pin 31 of an attachment device 32. The avoidance of a two-part construction of the cylindrical container wall with subsequent joining by a circumferential welded seam after the piping system has been inserted into the collecting container 3 has the advantage that heat development by the welding is avoided so that the components, i.e., the piping system 6, the dividing wall 23 and the pipe connecting piece 18 can be made cheaply from plastic.

At the head the solid end wall 28 makes it possible to reliably couple coupling blocks 33, 34 of each high-pressure connecting pipe for connection to the pipe system of the air-conditioning system. For this purpose a tightening screw 35 engages in the thread of a blind hole 36 which is provided in a central wall portion 37 of the end wall 28, which has been thickened to a larger dimension, and braces the coupling blocks 33, 34 so that connecting pieces 38, 39 provided on them are held with their front surface in sealing contact with a flat seal 40, 41, which abuts on the other side against the radial surface of an inwardly recessed hole of the connecting channels 3, 4 which receives the connecting pieces 38, 39. An attachment device 32 connected via the central opening 30 at the bottom consists, for example, of an overpressure safety device 43 having a bursting closure 42 according to the exemplary embodiment in FIG. 1 or of a remotely triggerable accident safety device 44 having a bursting closure 42 according to FIG. 2 and FIG. 3. Both have a casing member 45 or 46 having the threaded pin 31, whose casing space 47, 48 has at least one drainage channel 49, 50 or 51 directed transversely to the casing axis through which the operating medium can flow off after destroying the bursting closure 42 in order to remove the pressure in the piping system of the air-conditioning system within a short time.

The bursting closure 42 covers a central hole 52 leading into the casing space 47, 48 and therefore to the drainage channels 49, 50 or 51 with an outwardly arched closure wall in a membrane fashion and is held with a collar-shaped circumferential edge 53 in the fashion of a flat seal on the front side of a threaded sleeve 54 which is screwed into a threaded hole 55 of the thus hollow threaded pin 31. For screwing in the threaded sleeve 54, said sleeve has an inner engagement profiling 56.

Figure 3:
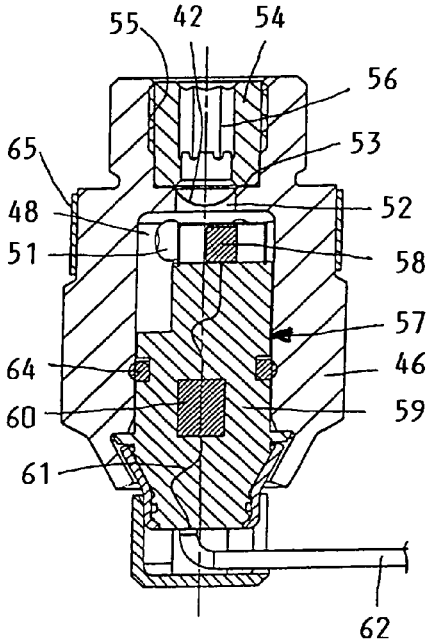
FIG. 3 is an enlarged axial section of a bursting membrane safety device according to FIG. 2.

In order to prevent a substantial quantity of $CO_2$ from being able to flow into the passenger compartment as a consequence of the area of the vehicle enclosing the piping system of the air-conditioning system being destroyed as a result of an accident, according to the exemplary embodiment of the invention in FIG. 2 and FIG. 3 an accident safety device 44 which can preferably be triggered remotely by the airbag system is provided by which means, after destruction of the bursting closure 42, most of the $CO_2$ inside the engine compartment of the vehicle is removed outside within a very short time. The triggering device 57 for destroying the bursting closure has an explosive member 58 which is arranged on the front of a plastic member 59 enclosed by the casing member 46 and thus opposite to the bursting closure 42. This plastic member 59 encloses an electrical trigger connection 61 guided via an electronic control unit 60 which is connected via an outer connecting cable 62 to a connector 63 by which means the accident safety device can be connected to the airbag system of the vehicle. For sealing the cylindrical plastic member 59 is enclosed on the outside by an O-ring 64 which abuts against the cylindrical inner surface of the casing space 48 in a sealing fashion. In addition, the outlet opening of the at least one radially outwardly directed flow channel 51 is covered by a sealing strip 65 enclosing the casing member 46 to protect the bursting closure 42 against influences of corrosion.

The exemplary embodiment of the invention according to FIG. 4 to FIG. 6 shows a variant for the execution of the piping system and for the tangential inflow and central outflow to form the cyclone flow. The piping system 66 of this exemplary embodiment has an inner pipe 67 and an outer pipe 68 coaxial thereto, which is arranged on the axis of the collecting container 3' and extends into its base region 69. The deflection 70 for the flow is formed by the inner pipe 67 ending open at a distance from the lower closed end region 71 of the outer pipe 68. The suction opening 72 for oil and/or for the liquid phase of the operating medium is located in the hemispherical lower end wall 73 of the outer pipe 68.

The open end piece 74 of the outer pipe 68 extends through the dividing wall 23 so that the cyclone flow can flow off centrally above the dividing wall 23 through the pipe opening 75.

In the central region of its axial extension this piping system is supported by three radially extending flat ribs 76 on the inner surface 17 of the collecting container 3.

In order to achieve an outflow direction starting from the first connecting channel 4 tangential to the cylindrical inner surface 17 of the collecting container 3, the connecting hole 77 of the first connecting channel 4 provided to receive the connecting piece 38 according to the diagram in FIG. 5, continues in an obliquely outwardly directed hole 78 tangential to the inner surface 17 of the collecting container, which is guided through the solid upper end wall 79 of the collecting container 3.

In order to provide a connection with the second connecting channel 5 in a simple fashion between the inner pipe 67 of the central piping system 66, a second oblique hole 81 runs from the receiving hole 80 for the connecting piece 39 through the solid upper end wall 79 of the collecting container 3. Since the connection to the inner pipe 67 is arranged underneath the blind hole 36 provided for the tightening screw 35, the upper solid end wall 79 of the collecting container 3 has a central inwardly directed spherical continuation 82 with an end holder attachment 83 to receive the inner pipe 67.

The invention claimed is:

1. A collector for the liquid phase of the working medium of an air-conditioning system, comprising a first and second connecting channel (4, 5) which are guided at a diametral distance and parallel to one another vertically through a solid head-side connecting wall (28) of a cylindrical collecting container (3) provided for the vertical arrangement and comprising a piping system (6) connected to the second connecting channel (5) which is guided through the interior of the collecting container (3) and runs through its bottom region (10) with a deflection (7, 70) and its end piece (9) discharges openly in the upper region (10) of the collecting container (3), wherein the piping system (6, 66) in the area of the deflection (7, 70) has at least one opening (11, 72) for returning collected oil into the circuit of the air-conditioning system, characterised in that the outflow direction of the first connecting channel (4) is directed tangentially to the cylindrical inner surface (17) of the collecting container (3) and the open end piece (9) of the piping system (6, 66) is arranged in the container axis so that the upper region (10) of the collecting container (3) forms a cyclone chamber.

2. The collector according to claim 1, characterised in that the first connecting channel (4) leads into a pipe connecting piece (18) which projects at least approximately vertically into the collecting container (3), which has at least one opening (19) on its circumference which is arranged such that its outflow direction runs tangentially to the cylindrical inner surface (17) of the collecting container (3).

3. The collector according to claim 1, characterised in that the cyclone chamber (10) is shielded with respect to the region of the collecting container (3) provided for storage of the liquid phase, which is located there-under, by a dividing wall (23) which surrounds the open end piece (9) of the piping (6) in a collar shape and extends as far as a circumferential drainage gap (22) onto the cylindrical wall (17) of the collecting container (3).

4. The collector according to claim 2, characterised in that the pipe connecting piece (18) projecting vertically into the collecting container (3) ends at the dividing wall (23) forming a shield, wherein its opening (19) extends axially parallel over at least approximately its overall length.

5. The collector according to claim 2, characterised in that the pipe connecting piece (18) having the opening (19) opens into a coaxial nozzle pipe (24) having a smaller diameter, which extends through the dividing wall (23).

6. The collector according to claim 1, characterised in that the collecting container (3) is constructed in one piece by plastic material forming from metal as a high-pressure container with a test pressure substantially higher than 100 bar, including its head-side solid end wall (28) and a base wall (29) which tapers in a bottle shape towards a central base opening (30).

7. The collector according to claim 6, characterised in that the first and second connecting channel (4, 5) which are guided, at a diametral distance and parallel to one another, vertically through the solid head-side end wall (28), have a recessed hole whose radial surface forming the recess forms a seating surface for the flat seal (38) of connecting pieces (38, 39) projecting into this hole and that in the head-side end wall (28) centrally between the connecting channels (4, 5) a threaded hole (36) is provided for receiving a tightening screw (35) wherein the tightening screw (35) is intended for pressing against at least one pipe coupling block (33, 34) on which at least one of the connecting pieces (38, 39) is formed.

8. The collector according to claim 1, characterised in that the collecting container (3) tapers towards a central base opening (30), forming a thickening base wail (29) and ends in a bottle neck shape, wherein a connecting thread for the connecting piece (31) of an attachment device (32) is formed in the base opening (30).

9. The collector according to claim 1, characterised in that the attachment device (32) has a bursting closure (42, 43) as an overpressure safety device (43) or a remotely-triggerable accident safety device (44), which seals the base opening (30) of the collecting container (3).

10. The collector according to claim 9, characterised in that the triggering device (57) of the accident safety device (44) has an explosive member (58) for destroying the bursting closure, which is arranged on the front side of a plastic member (59) enclosed by its casing member (46) and opposite to the bursting closure (42), wherein an electrical trigger connection (61) leading to the explosive member (58) via an electronic control unit (60) extends through this plastic member (59) and the trigger connection (61) is continued outwards into an external connecting cable (62) which is intended for connection to the airbag system of a vehicle.

11. The collector according to claim 1, characterised in that the piping system has a pipe (6) which is guided in a U-shape through the interior of the collecting container (3) 50 that the U-bend (7) runs through its base region (8).

12. The collector according to claim 1, characterised in that the piping system (66) has an inner pipe (67) and an outer pipe (68) coaxial thereto which are arranged on the axis of the collecting container (3') and extend into its base region (69) wherein the deflection (70) for the flow is constructed such that the inner pipe (67) ends open at a distance from the lower closed end region (71) of the outer pipe (68).

13. The collector according to claim 1, characterised in that a hole (77) of the first connecting channel (4) provided to receive the connecting piece (38) of a pipe system of the air-conditioning system is continued into a channel (78) directed obliquely outwards and tangentially to the inner surface (17) of the collecting container (3') which is guided as a hole through the solid upper end wall (79) of the collecting container (3).

14. The collector according to claim 12, characterised in that an oblique hole (81) runs from a receiving hole (80) for a connecting piece (39) of the second connecting channel (5) through the solid upper end wall (79) of the collecting container (3), said oblique hole ending at the centre of the collecting container (3) and forming a connection to the inner pipe (67) of the central piping system (66).

15. The collector according to claim 1, characterised in that at least some of the components (6, 66, 23, 18) of the collecting container (3) closed at the bottom by cold forming are formed of plastic.

* * * * *